US006482276B2

(12) United States Patent
Hirai et al.

(10) Patent No.: US 6,482,276 B2
(45) Date of Patent: Nov. 19, 2002

(54) COPPER ALLOY WITH PUNCHABILITY, AND A MANUFACTURING METHOD THEREOF

(75) Inventors: Takao Hirai; Yoshimasa Ohyama; Takayuki Usami, all of Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/832,280

(22) Filed: Apr. 10, 2001

(65) Prior Publication Data

US 2001/0052377 A1 Dec. 20, 2001

(30) Foreign Application Priority Data

Apr. 10, 2000 (JP) ..... 2000-108580

(51) Int. Cl.[7] ..... C22C 9/02
(52) U.S. Cl. ..... 148/433; 148/682; 420/476
(58) Field of Search ..... 420/476; 148/682, 148/433

(56) References Cited

FOREIGN PATENT DOCUMENTS

| | | | |
|---|---|---|---|
| JP | 59-193233 | | 11/1984 |
| JP | 2-118037 | | 5/1990 |
| JP | 2-170937 | | 7/1990 |
| JP | 3031437 | * | 2/1991 |
| JP | 4231447 | * | 8/1992 |
| JP | 6108212 | * | 4/1994 |
| JP | 07-054079 | | 2/1995 |
| JP | 7-090520 | | 4/1995 |
| JP | 9302427 | * | 11/1997 |
| JP | 10-330867 | | 12/1998 |
| JP | 11-043731 | | 2/1999 |

* cited by examiner

*Primary Examiner*—Sikyin Ip
(74) *Attorney, Agent, or Firm*—Knobbe, Martens Olson & Bear LLP

(57) ABSTRACT

A copper alloy with excellent punchability, comprising 0.2 to 0.35 wt % of Cr, 0.1 to 0.5 wt % of Sn, and 0.1 to 0.5 wt % of Zn, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A.

14 Claims, No Drawings

COPPER ALLOY WITH PUNCHABILITY, AND A MANUFACTURING METHOD THEREOF

FIELD OF THE INVENTION

The present invention relates to a copper alloy suitable for a lead frame material, a terminal and/or connector material, a switch material, or the like, processed in a desired shape through a process including a punching step. Further the present invention relates to a method for manufacturing the copper alloy.

BACKGROUND OF THE INVENTION

Conventionally, a copper-series material with excellent electric and thermal conductivity, as well as iron-series material, is frequently employed for a lead frame material or a terminal material. Such a copper-series material is also employed for a semiconductor device member, whose heat radiation property has been important in accordance with the advancement of high integration and miniaturization of the semiconductor member.

When a copper-series material is used for a lead frame, the material must have excellent plating properties for precious metal (such as Ag or Pd) or solder, and surface smoothness, as well as electric and thermal conductivity.

Although a variety of lead frame copper alloys were developed to meet such requirements in the past, not many such copper alloys were satisfactory. Thus, only several types of the alloys are employed now. Among them, a Cu—Cr—Sn-series alloy is recognized as being compatible with high conductivity and high mechanical strength, so that it is one of the most frequently used alloys.

In the meantime, although a punching method or etching method is generally applied for lead frame mold processing, the punching method is frequently used from the standpoint of productivity.

However, with respect to the conventional Cu—Cr—Sn-series alloy, burring or generation of processing powder occurs during punching, that causes short-circuiting between leads or reduced dimensional precision of a lead frame. If burring occurs, the metal die maintenance cycle is made short, and the manufacturing cost increases. In particular, these problems are significant in a multi-pin type lead frame.

For a lead frame manufacturer, low-cost lead frames are demanded according to the fast-grow of semiconductor industry. Thus, they are important tasks how the rate of operation of punching facilities is raised, and how punch faults are decreased and product yields are increased. In particular, in the lead frame made of the Cu—Cr—Sn-series alloy, with its demand increased, significant improvement of punchability (punching processability) is strongly desired.

SUMMARY OF THE INVENTION (1) A copper alloy with excellent punchability, comprising 0.2 to 0.35 wt % of Cr, 0.1 to 0.5 wt % of Sn, and 0.1 to 0.5 wt % of Zn, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A (hereinafter, this copper alloy is referred to as a first embodiment of the present invention).

(2) A copper alloy with excellent punchability, comprising 0.2 to 0.35 wt % of Cr, 0.1 to 0.5 wt % of Sn, and 0.1 to 0.5 wt % of Zn, and further comprising at least one selected from the group consisting of 0.001 to 0.06 wt % of Pb, 0.001 to 0.06 wt % of Bi, 0.005 to 0.1 wt % of Ca, 0.005 to 0.1 wt % of Sr, 0.005 to 0.1 wt % of Te, 0.005 to 0.1 wt % of Se, and 0.005 to 0.1 wt % of a rare earth element, in a total amount of 0.001 to 0.1 wt %, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A (hereinafter, this copper alloy is referred to as a second embodiment of the present invention).

(3) A copper alloy with excellent punchability, comprising 0.2 to 0.35 wt % of Cr, 0.1 to 0.5 wt % of Sn, 0.1 to 0.5 wt % of Zn, and 0.005 to 0.1 wt % of Si, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A (hereinafter, this copper alloy is referred to as a third embodiment of the present invention).

(4) A copper alloy with excellent punchability, comprising 0.2 to 0.35 wt % of Cr, 0.1 to 0.5 wt % of Sn, 0.1 to 0.5 wt % of Zn, 0.005 to 0.1 wt % of Si, and further comprising at least one selected from the group consisting of 0.001 to 0.06 wt % of Pb, 0.001 to 0.06 wt % of Bi, 0.005 to 0.1 wt % of Ca, 0.005 to 0.1 wt % of Sr, 0.005 to 0.1 wt % of Te, 0.005 to 0.1 wt % of Se, and 0.005 to 0.1 wt % of a rare earth element, in a total amount of 0.001 to 0.1 wt %, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A (hereinafter, this copper alloy is referred to as a fourth embodiment of the present invention).

(5) A method of manufacturing a copper alloy with excellent punchability as stated in any one of the above (1) to (4), by subjecting the copper alloy at least to a hot working and a cold working, wherein heat treatment is applied at a temperature of 880 to 980° C. before the hot working, and aging treatment is applied at a temperature of 360 to 470° C. before or after the cold working.

DETAILED DESCRIPTION OF THE INVENTION

Although the present invention relates to a copper alloy particularly suitable for a lead frame material, it is applicable to general materials manufactured in a process containing punching, such as a terminal material used for automobiles or a connector material used for commercially available equipment.

The copper alloy of the present invention is primarily characterized in that, in a Cu matrix, there coexist a precipitation phase A of coarse Cr or a Cr component of 0.1 to 10 μm in maximum diameter, for improving punchability, and a precipitation phase B of fine Cr or a Cr compound of 0.001 to 0.030 μm (1 nm to 30 nm) in maximum diameter, for ensuring mechanical strength. The maximum diameter referred to here means the diameter of a sphere when a precipitation phase is spherical; a long diameter when the phase is elliptical; and the maximum length when the phase is bar-shaped.

The inventors conducted research for a copper alloy-series and found out that an ideal precipitation state of Cr or a Cr compound can be achieved by specific amount of components and definition of manufacturing conditions, to obtain a copper alloy with excellent practicality.

The copper alloy of the present invention is preferably manufactured by subjecting it to heat treatment at 880 to 980° C. before hot working, to precipitate coarse Cr or a Cr compound, and further subjecting it to aging treatment at 360 to 470° C., to precipitate fine Cr or a Cr compound.

Now, reasons for defining alloy components of a copper alloy according to the present invention will be described.

Conventionally, when Cr was added into Cu, only precipitation and hardening of Cr were expected. The size of each of the precipitation phases of Cr or a Cr compound dispersing in the Cu matrix, was 0.001 to 0.030 μm in maximum diameter, and almost no coarse precipitation phase of 0.1 to 10 μm in maximum diameter was existed.

The present invention has been made by finding out that to attain improved advantageous effect both on punchability, and precipitation and hardening, and thus, it is required to define Cr component to a specific range.

In the present invention, if an amount of Cr is less than 0.2 wt %, even if heat treatment before hot working is carried out at 980° C., almost no coarse precipitation phase A precipitates, and thus, punchability is not improved. Conversely, if an amount of Cr exceeds 0.35 wt %, Cr is produced as a crystallized material during casting solidification. This crystallized Cr can be a starting point of breaking during punching process, and thus it can be effective for punching. However, the Cr disperses sparsely due to the nature of a crystallized material, and its size tends to be coarse (greater than 10 μm). That is, even if Cr is added in excess of 0.35 wt %, an advantageous effect proportional to an addition amount cannot be obtained. In addition, a crystallized Cr material of size exceeding 10 μm is inadequate, in that abrasion of tools is accelerated, and the service life of a metal die is made short.

From the above viewpoint, the amount of the content of Cr was defined to be 0.2 to 0.35 wt %.

As described above, the present invention is mainly characterized in that a coarse precipitation phase A of Cr or a Cr compound, and a fine precipitation phase B, coexist.

As the coarse precipitation phase A in the present invention improves punchability as a starting point of breaking, a precipitation phase of less than 0.1 μm in maximum diameter cannot be a starting point of breaking. Thus, the improvement of punchability, which is an object of the present invention, cannot be achieved. Conversely, a precipitation phase of more than 10 μm in maximum diameter is not preferable, because the life of a punching metal die is reduced. Therefore, a state, in which a precipitation phase A of 0.1 to 10 μm in maximum diameter disperses in proper quantity, is ideal.

If the density in number of the coarse precipitation phase A is less than $1\times10^3/mm^2$, the punchability is not improved. If $3\times10^5/mm^2$ is exceeded, the precipitation phase B decreases, with an increase of the precipitation phase A, and the strength characteristics are lowered. Therefore, the density in number of the precipitation phase A is set to be $1\times10^3$ to $3\times10^5/mm^2$.

On the other hand, a fine precipitation phase B, which precipitates at the nanometer level, improves strength characteristics. The required strength characteristics cannot be obtained unless the density in number of the precipitation phase B is at least 10 times or more of that of the precipitation phase A. If the fine precipitation phase B increases excessively in quantity, the density in number of the coarse precipitation phase A, which improves punchability, is lowered. Therefore, the density in number of the precipitation phase B may be set suitably so as to attain sufficient strength characteristics and punchability.

The present invention relates to a copper alloy with improved punchability by limiting the size and density in number of each of the precipitation phase A of Cr or a Cr compound, and the precipitation phase B, as well as the content of Cr.

Sn has an advantageous effect on enhancing the material strength characteristics. If its content is less than 0.1 wt %, the advantageous effect cannot be sufficiently obtained. If 0.5 wt % is exceeded, the conductivity is significantly lowered. Therefore, the contents of Sn range from 0.1 to 0.5 wt %.

Zn has an advantageous effect of improving resistance to peeling of solder or plating under heat of Sn plating or solder plating, and migration resistance. In particular, when Zn is used as a lead frame or a terminal, the degradation of a soldering portion after mounting with time is important. Thus, the addition of Zn is indispensable. If its content is less than 0.1 wt %, a sufficient advantageous effect cannot be achieved. Conversely, if the content exceeds 0.5 wt %, an advantageous effect proportional to such quantity added cannot be achieved, and in addition, the conductivity is lowered. Therefore, the contents of Zn range from 0.1 to 0.5 wt %.

Pb, Bi, Ca, Sr, Te, Se, and a rare earth element, such as Sc, Y, or La, can be added to improve punchability. These elements have small solid solubility into the Cu matrix and they are dispersed in the Cu matrix, and thus they improve punchability, as a starting point of breaking, like Cr or a Cr compound. However, these elements cause damages to properties required for production, such as casting property or hot working property, and therefore their addition quantity must be strictly controlled.

Pb and Bi are hardly solid-soluble in the Cu matrix, and therefore, the effect on improving punchability is significantly. It is recognized that the effect on improving punchability appears by adding them in amounts of 0.001 wt % or more of Pb and Bi, respectively. However, the manufacturing properties are greatly affected by such addition, and an alloy cannot be normally manufactured if Pb and Bi are added in excess of 0.06 wt %.

An effect on improving punchability appears by adding Ca, Sr, Te, Se, and a rare earth element in quantity of 0.005 wt % or more of Ca, Sr, Te, Se, and a rare earth element, respectively. If these elements are added in excess of 0.1 wt %, the casting property and hot working property are damaged.

Therefore, the adding quantity of one of these elements is controlled as described above, and the total amount of addition of two or more elements is defined to be 0.001 to 0.1 wt %.

Now, Si, contained in a copper alloy according to the third embodiment and fourth embodiment of this invention, will be described.

Si forms a Cr—Si compound by its addition in a small amount letting Cr easily precipitate. As a result, the density in number of a precipitation phase A increases, and the punchability is significantly improved. If its content is less than 0.005 wt %, the Cr—Si compound is hardly formed. If it exceeds 0.1 wt %, the precipitation phase A excessively increases, the precipitation phase B decreases with this increase, and the strength characteristics are lowered. In addition, the quantity of Si in the solid solution increases, and the conductivity is lowered.

Preferably Si is added to make Cr:Si=3:1 in terms of the ratio of number of atom, so that Si can exist as $Cr_3Si$.

Now, reasons why Si has been particularly selected. from among a number of elements will be described.

According to an object of the present invention, it is required to produce Cr compound by reacting with Cr. Elements for producing Cr compound include P, S, O, Ge, and Pt, as well as Si. Among them, P, S, and O have very strong force in binding with Cr, because they are non-metal elements, and a compound is produced during dissolving and/or casting. Thus, its dispersion state is substantially uncontrollable. In addition, Ge and Pt are hardly dissolved, and they are expensive, so their use is not practical. Because of this, Si was selected, which is most effective in every respect.

In the above-described compound of the present invention, the manufacturing method is important in order to preferably achieve the required characteristics.

According to the present invention, the density in number of the large precipitation phase A, which improves punchability, is controlled to $1\times10^3$ to $3\times10^5/mm^2$, by limiting the heat treatment temperature before hot working to 880 to 980° C.

Conventionally, in the case of a Cu—Cr-series alloy, the heat treatment temperature before hot working has been in excess of 980° C. This is because the above heat treatment was carried out to completely dissolve Cr as a solid solution, and heat treatment was not carried out at a temperature of 980° C. or less, at which Cr precipitates.

If the heat treatment temperature is higher than 980° C., the density in number of the precipitation phase A of coarse Cr or a Cr compound, of 0.1 to 10 $\mu$m in maximum diameter, is lowered, and the punchability is not improved.

Conversely, if the heat treatment temperature is less than 880° C., the density in number of the precipitation phase A is excessively high. Thus, the density in number of the precipitation phase B, of 0.001 to 0.030 $\mu$m, which precipitates during the subsequent process, is lowered, and the required strength characteristics cannot be obtained.

From such a viewpoint, the heat treatment temperature before hot working is in the range of from 880 to 980° C. In particular, the temperature is preferably 910 to 940° C.

In the present invention, the density in number of the fine precipitation phase B, which contributes to improving strength characteristics, is controlled to be 10 times or more of that of the precipitation phase A, by limiting the aging treatment temperature to 360 to 470° C.

If the aging treatment temperature is less than 360° C., the precipitation phase B does not precipitate sufficiently. If the temperature exceeds 470° C., the precipitation phase B is coarsened. In any case as well, the required strength characteristics cannot be achieved.

This aging treatment is applied before or after cold working has been carried out following hot working; however, the treatment may be applied during cold working. In this case, it is recommended that annealing be applied at a comparatively low temperature after cold working, and that working strain be reduced.

When the above low-temperature annealing is applied according to batch-type annealing, preferably the annealing is carried out at a temperature of 200 to 400° C., for 0.5 to 5 hours. When the above annealing is applied according to running annealing, preferably the annealing is carried out at a temperature of 600 to 800° C., for 5 to 60 seconds.

Correction treatment may be carried out by a tension leveler, a roller leveler, or the like, before or after final heat treatment (aging treatment or low-temperature annealing), as required.

As has been described above, according to the copper alloy of the present invention, in the Cu matrix of a Cu—Cr-series alloy, a precipitation phase A of Cr or a Cr compound of 0.1 to 10 $\mu$m in maximum diameter, is provided, at a density in number of $1\times10^3$ to $3\times10^5/mm^2$, to improve punchability and a precipitation phase B of Cr or a Cr compound of 0.001 to 0.030 $\mu$m in maximum diameter, is provided, at a density in number that is 10 times or more of that of the precipitation phase A, to improve strength characteristics. This alloy can be applied to general conductive materials, such as terminal connectors, switches, relay materials, punched by a press, including multi-pin and small pitch lead frames finely punched, thereby ensuring improvement of productivity. In addition, the copper alloy of the present invention can be easily manufactured by subjecting it to heat treatment at a temperature 880 to 980° C. before hot working, and subjecting it to aging treatment at 360 to 470° C. before or after cold working. Therefore, a significant advantageous effect is achieved from the industrial viewpoint.

The present invention will be described in more detail based on examples given below, but the present invention is not meant to be limited by these examples.

EXAMPLES

Example 1

An alloy, whose composition was within the definition according to the present invention, as shown in Table 1, was dissolved in a high-frequency dissolving furnace, and the dissolved alloy was casted to be an ingot of 30 mm in thickness, 100 mm in width, and 150 mm in length. This ingot was subjected to heat treatment at 930° C. for 2 hours, and then it was hot-rolled to 11 mm in thickness. After hot rolling, the hot-rolled metal was immediately immersed in water and cooled quickly. Then, both surfaces were subject to facing by 1 mm, and then the resultant material was cold-rolled to 0.25 mm in thickness. This cold-rolled material was subjected to aging treatment at 425° C. for 2 hours, in an inactive gas atmosphere. Then, the processed material was cold-rolled to be finished to 0.15 mm, and it was subjected to low-temperature annealing, at 300° C. for 2 hours, to produce a copper alloy sheet.

Comparative Example 1

A copper alloy sheet was produced in the same manner as in Example 1, except that use was made of an alloy whose composition was outside the definition according to the present invention, as shown in Table 1.

Each test specimen was cut out from each of the copper alloy sheets produced in Example 1 and Comparative Example 1, and we investigated the density in number of each of the precipitation phases A and B, tensile stress, elongation, electric conductivity, punchability, and resistance to peeling of solder or plating under heat. The results are shown in Table 2.

With respect to the density in number of the precipitation phase A, the test specimen was immersed in an acidic water solution (6 volume % $H_2SO_4$+7 volume % $H_2O_2$) for 30 seconds, and then it was etched. Then, the surface of the resultant test specimen was photographed using a scanning-type electron microscope (×500), to measure the density in number.

The density in number of the precipitation phase B was measured using a transmission-type electron microscope. The accelerating voltage was set to 300 kV.

In the transmission-type electron microscope, the density in number of the precipitation phase B may appear differently depending on the thickness of specimens. Thus, the density in number was measured at three sites of different thickness for each specimen. Then, only when the density in number of the precipitation phase B was 10 times or more of that of the precipitation phase A at each of the above three sites, it was defined "the density in number of the precipitation phase B was to be 10 times or more of that of the precipitation phase A". Other cases were defined as being less than 10 times.

The tensile stress (TS) and elongation (El) were measured according to JIS Z 2241, and the electric conductivity (EC), indicating thermal and electric conductivity, was measured according to JIS H 005.

By punching a number of rectangular holes (1 mm×5 mm) with a die, the punchability was examined, with respect to an FAR (the Fracture Area Ratio), a burring height, and an abrasion wear of the die. The die and punch of the above die were made of an ultra-hard alloy, and the clearance between them was set to 9 $\mu$m (6% in ratio to the sheet thickness).

With respect to the above FAR, a rectangular-hole worked face was observed, and the thickness "t" of the fracture area was measured. The value (t/T), obtained by dividing the measured value "t" by the thickness "T" of a test specimen before punching, was calculated at 20 sites, and evaluation was carried out at the average value (percentage). As the FAR increases, better punchability can be achieved.

With respect to the burring height, the height of burring at the edge of the rectangular hole was measured at 20 sites, using a contact-type shape-measuring instrument, and was indicated by its average value.

The abrasion wear of the die was evaluated using a contact-needle-type contour-shape-measuring instrument, by obtaining the difference (S−s) between an initial sectional area "S" at the tip end face of a punch, and a sectional area "s" after 1,000,000 punching counts.

With respect to the resistance to peeling of solder of plating under heat, a rosin-series flux was applied to a test specimen, the applied test specimen was immersed in a eutectic solder (Pb—63 wt % Sn alloy) at 230° C. for 5 seconds, thereby depositing the solder. Then, the immersed test specimen was heated at 150° C. for 1000 hours in atmospheric air, the heated test specimen was bent at 180 degrees to contact, and then it was bent back. Then, whether there was peeling of solder at the bent back portion or not was observed with the naked eye, to evaluate.

TABLE 1

| Classification | Sample No. | Alloy No. | Cr wt % | Sn wt % | Zn wt % | Si wt % | Other elements wt % | Density in number of precipitation phase A/mm$^2$ | Density in number of precipitation phase B |
|---|---|---|---|---|---|---|---|---|---|
| Examples according to this invention | 1 | a | 0.27 | 0.25 | 0.20 | — | — | $2 \times 10^4$ | 10 times or more of A |
| | 2 | b | 0.30 | 0.25 | 0.20 | — | — | $3 \times 10^4$ | 10 times or more of A |
| | 3 | c | 0.26 | 0.40 | 0.15 | — | — | $2 \times 10^4$ | 10 times or more of A |
| | 4 | d | 0.27 | 0.25 | 0.20 | 0.02 | — | $3 \times 10^4$ | 10 times or more of A |
| | 5 | e | 0.27 | 0.25 | 0.20 | 0.02 | Pb 0.02 | $3 \times 10^4$ | 10 times or more of A |
| | 6 | f | 0.30 | 0.25 | 0.20 | 0.02 | Bi 0.01 | $4 \times 10^4$ | 10 times or more of A |
| | 7 | g | 0.28 | 0.25 | 0.20 | 0.01 | — | $2 \times 10^4$ | 10 times or more of A |
| | 8 | h | 0.27 | 0.25 | 0.20 | 0.03 | Pb 0.02 | $4 \times 10^4$ | 10 times or more of A |
| | 9 | i | 0.33 | 0.25 | 0.20 | — | — | $4 \times 10^4$ | 10 times or more of A |
| | 10 | j | 0.33 | 0.25 | 0.20 | — | Pb 0.02, Bi 0.01 | $4 \times 10^4$ | 10 times or more of A |
| | 11 | k | 0.25 | 0.25 | 0.20 | — | Sr 0.01 | $2 \times 10^4$ | 10 times or more of A |
| | 12 | l | 0.27 | 0.25 | 0.20 | 0.02 | Pb 0.01, Te 0.01 | $3 \times 10^4$ | 10 times or more of A |
| | 41 | u | 0.27 | 0.25 | 0.20 | 0.02 | Pb 0.002 | $3 \times 10^4$ | 10 times or more of A |
| Comparative Examples | 13 | m | 0.17 | 0.25 | 0.20 | — | — | $5 \times 10^2$ | 10 times or more of A |
| | 14 | n | 0.16 | 0.25 | 0.20 | 0.02 | Pb 0.02 | $4 \times 10^2$ | 10 times or more of A |
| | 15 | o | 0.27 | 0.71 | 0.20 | 0.02 | — | $3 \times 10^4$ | 10 times or more of A |
| | 16 | p | 0.27 | 0.25 | — | — | — | $2 \times 10^4$ | 10 times or more of A |
| | 17 | q | 0.43 | 0.25 | 0.20 | 0.02 | Pb 0.02 | $5 \times 10^4$ | 10 times or more of A |
| | 18 | r | 0.27 | 0.25 | 0.20 | 0.20 | Pb 0.01 | $5 \times 10^4$ | Less than 10 times of A |
| | 19 | s | 0.27 | 0.25 | 0.20 | 0.02 | Te 0.05, Pb 0.07 | Measurement impossible | Measurement impossible |
| | 20 | t | 0.27 | 0.25 | 0.20 | — | — | $2 \times 10^2$ | 10 times or more of A |
| | 42 | v | 0.27 | 0.25 | 0.20 | 0.2 | Bi 0.09 | Measurement impossible | Measurement impossible |

Note:
Precipitation phase A: 0.1 to 10 $\mu$m in size of Cr or a Cr compound.
Precipitation phase B: 0.001 to 0.030 $\mu$m in size of Cr or a Cr compound.
—: not contained.

TABLE 2

| Classification | Sample No. | Alloy No. | TS N/mm$^2$ | El % | EC % IACS | Punchability FAR % | Burring ($\mu$m) | Abrasion wear of die × $10^{-4}$ mm$^2$ | Resistance to peeling of solder or plating under heat |
|---|---|---|---|---|---|---|---|---|---|
| Examples according to this invention | 1 | a | 560 | 8 | 73 | 42 | 3 | 3 | No peeling |
| | 2 | b | 560 | 7 | 74 | 45 | 3 | 2 | No peeling |
| | 3 | c | 570 | 9 | 66 | 43 | 4 | 3 | No peeling |
| | 4 | d | 560 | 7 | 73 | 47 | 2 | 2 | No peeling |
| | 5 | e | 560 | 7 | 73 | 51 | 2 | 2 | No peeling |
| | 6 | f | 560 | 6 | 72 | 56 | 2 | 2 | No peeling |
| | 7 | g | 560 | 8 | 73 | 45 | 3 | 2 | No peeling |
| | 8 | h | 560 | 6 | 72 | 53 | 2 | 2 | No peeling |
| | 9 | i | 560 | 7 | 73 | 50 | 2 | 2 | No peeling |
| | 10 | j | 565 | 6 | 73 | 53 | 2 | 2 | No peeling |
| | 11 | k | 565 | 8 | 71 | 49 | 2 | 2 | No peeling |
| | 12 | l | 560 | 6 | 71 | 51 | 2 | 2 | No peeling |
| | 41 | u | 560 | 9 | 72 | 49 | 3 | 2 | No peeling |
| Comparative Examples | 13 | m | 520 | 11 | 73 | 29 | 7 | 5 | No peeling |
| | 14 | n | 520 | 10 | 73 | 33 | 6 | 4 | No peeling |
| | 15 | o | 580 | 8 | 59 | 46 | 2 | 2 | No peeling |
| | 16 | p | 550 | 8 | 77 | 40 | 3 | 3 | Peeling |
| | 17 | q | 580 | 5 | 71 | 57 | 2 | 9 | No peeling |
| | 18 | r | 490 | 6 | 66 | 47 | 4 | 4 | No peeling |
| | 19 | s | No evaluation was carried out because cracks occurred during manufacture. | | | | | | |
| | 20 | t | 575 | 13 | 73 | 30 | 7 | 6 | No peeling |
| | 42 | v | No evaluation was carried out because cracks occurred during manufacture. | | | | | | |

As is apparent from the result in Table 2, No.1 to No.12, and No.41, which are examples according to the present invention, exhibited excellent punchability, and they are also had good resistance to peeling of solder or plating under heat.

In contrast, No.13 and No.14, with a too small amount of Cr, which are comparative examples, were poor in punchability, because of their small amount in precipitation phase A. No.15, with a too large amount of Sn, was low in electric conductivity, and No.16, free of Zn, was poor in resistance to peeling of solder or plating under heat. No.17, with a too large amount of Cr, was significantly worn in punching. No.18, with a too large amount of Si, was high in the density in number of precipitation phase A, while the density in number of precipitation phase B was lowered, thereby the strength characteristics were poor. No.19, in a total amount of more than 0.1 wt % of the above other elements, and No.42, with a too large amount of Bi, were not normally manufactured because cracks occurred during hot rolling.

Example 2

A copper alloy sheet was produced in the same manner as in Example 1, except that No.5 alloy whose composition was within the definition according to the present invention, as shown in Table 1, was employed, and heat treatment before hot rolling and aging treatment after cold rolling were variously changed under the conditions within the definition according to the present invention as stated in the above item (5).

Comparative Example 2

A copper alloy sheet was produced in the same manner as in Example 2, except that heat treatment before hot rolling or aging treatment after cold rolling was variously changed under the conditions outside of the definition according to the present invention as stated in the above item (5).

Each test specimen was cut out from each of the copper alloy sheets produced in Example 2 and Comparative Examples 2, and a variety of characteristics were examined, in the same manner as in Example 1.

The producing conditions are shown in Table 3, and the examined results are shown in Tables 3 and 4.

TABLE 3

| Classification | Sample No. | Alloy No. | Heat treatment condition ° C. × hrs | Aging treatment condition ° C. × hrs | Density in number of precipitation phase A/mm$^2$ | Density in number of precipitation phase B | Remarks |
|---|---|---|---|---|---|---|---|
| Examples according to this invention | 21 | e | 930 × 2 | 425 × 2 | 3 × $10^4$ | 10 times or more of A | Same as No. 5 |
| | 22 | e | 915 × 2 | 425 × 2 | 7 × $10^4$ | 10 times or more of A | Same as No. 5 |

TABLE 3-continued

| Classification | Sample No. | Alloy No. | Heat treatment condition ° C. × hrs | Aging treatment condition ° C. × hrs | Density in number of precipitation phase A/mm$^2$ | Density in number of precipitation phase B | Remarks |
|---|---|---|---|---|---|---|---|
| | 23 | e | 905 × 2 | 425 × 2 | $1 \times 10^5$ | 10 times or more of A | Same as No. 5 |
| | 24 | e | 935 × 2 | 425 × 2 | $2 \times 10^4$ | 10 times or more of A | Same as No. 5 |
| | 25 | e | 945 × 2 | 425 × 2 | $7 \times 10^3$ | 10 times or more of A | Same as No. 5 |
| | 26 | e | 895 × 2 | 425 × 2 | $2 \times 10^5$ | 10 times or more of A | Same as No. 5 |
| | 27 | e | 930 × 2 | 410 × 2 | $3 \times 10^4$ | 10 times or more of A | Same as No. 5 |
| | 28 | e | 910 × 2 | 410 × 2 | $8 \times 10^4$ | 10 times or more of A | Same as No. 5 |
| Comparative Examples | 29 | e | 1000 × 2 | 425 × 2 | $2 \times 20^2$ | 10 times or more of A | Same as No. 5 |
| | 30 | e | 860 × 2 | 425 × 2 | $>3 \times 10^5$ | Less than 10 times of A | Same as No. 5 |
| | 31 | e | 930 × 2 | 330 × 2 | $3 \times 10^4$ | Less than 10 times of A | Same as No. 5 |
| | 32 | e | 930 × 2 | 630 × 2 | $3 \times 10^4$ | Less than 10 times of A | Same as No. 5 |

Note:
Precipitation phase A: 0.1 to 10 μm in size of Cr or a Cr compound
Precipitation phase B: 0.001 to 0.030 μm in size of Cr or a Cr compound

TABLE 4

| | | | | | | Punchability | | | Resistance to |
|---|---|---|---|---|---|---|---|---|---|
| Classification | Sample No. | Alloy No. | TS N/mm$^2$ | El % | EC % IACS | FAR % | Burring (μm) | Abrasion wear of die × $10^{-4}$ mm$^2$ | peeling of solder or plating under heat |
| Examples of the present invention | 21 | e | 560 | 7 | 73 | 51 | 2 | 2 | No peeling |
| | 22 | e | 550 | 9 | 74 | 55 | 2 | 2 | No peeling |
| | 23 | e | 540 | 10 | 74 | 56 | 2 | 2 | No peeling |
| | 24 | e | 560 | 7 | 73 | 49 | 2 | 2 | No peeling |
| | 25 | e | 565 | 7 | 72 | 40 | 3 | 2 | No peeling |
| | 26 | e | 530 | 12 | 75 | 47 | 3 | 3 | No peeling |
| | 27 | e | 575 | 6 | 71 | 54 | 2 | 2 | No peeling |
| | 28 | e | 560 | 7 | 72 | 55 | 2 | 2 | No peeling |
| Comparative Examples | 29 | e | 570 | 13 | 72 | 29 | 7 | 5 | No peeling |
| | 30 | e | 480 | 15 | 74 | 30 | 9 | 4 | No peeling |
| | 31 | e | 610 | 5 | 60 | 55 | 2 | 2 | No peeling |
| | 32 | e | 440 | 22 | 66 | 22 | 10 | 7 | No peeling |

As is apparent from the results shown in Tables 3 and 4, No.21 to No.28 which are examples according to the present invention exhibited excellent punchability, and they also had good resistance to peeling of solder and plating under heat.

In contrast, in No.29 which is a comparative example, the heat treatment temperature before hot rolling was too high. Thus, the precipitation phase A hardly existed, and the punchability was poor.

In No.30 which is another comparative example, the heat treatment temperature before hot rolling was too low. Thus, the density in number of the precipitation phase A was too high, while the density in number of the precipitation phase B was lowered, and therefore the strength characteristics were lowered. The punchability was poor in spite of a large number of coarse precipitation phase A. This is because certain mechanical strength is required to improve punchability.

In No.31 which is another comparative example, the aging treatment temperature was too low. Thus, the amount of solid solution elements were increased, and the conductivity was lowered.

In No.32 which is another comparative example, the aging treatment temperature was as high as 630° C. Thus, the precipitation phase B was hardly observed, the mechanical strength was quite low, and the punchability was poor. In addition, a large amount of solid solution elements were present, and thus, the electric conductivity was comparatively low. In this test specimen, a large, number of precipitation phases, of 0.04 to 0.07 μm in maximum diameter, were observed, which were resulted by growing of the precipitation phase B, instead of the fine precipitation phase B.

Having described our invention as related to the present embodiments, it is our intention that the invention not be limited by any of the details of the description, unless otherwise specified, but rather be construed broadly within its spirit and scope as set out in the accompanying claims.

What we claim is:

1. A copper alloy with excellent punchability, comprising 0.2 to 0.35 wt % of Cr, 0.1 to 0.5 wt % of Sn, and 0.1 to 0.5 wt % of Zn, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A.

2. A copper alloy with excellent punchability, comprising 0.2 to 0.35 wt % of Cr, 0.1 to 0.5 wt % of Sn, and 0.1 to 0.5 wt % of Zn, and further comprising at least one selected from the group consisting of 0.001 to 0.06 wt % of Pb, 0.001 to 0.06 wt % of Bi, 0.005 to 0.1 wt % of Ca, 0.005 to 0.1 wt % of Sr, 0.005 to 0.1 wt % of Te, 0.005 to 0.1 wt % of Se, and 0.005 to 0.1 wt % of a rare earth element, in a total amount of 0.001 to 0.1 wt %, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A.

3. A copper alloy with excellent punchability, comprising 0.2 to 0.35 wt % of Cr, 0.1 to 0.5 wt % of Sn, 0.1 to 0.5 wt % of Zn, and 0.005 to 0.1 wt % of Si, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A.

4. A copper alloy with excellent punchability, comprising 0.2 to 0.35 wt % of Cr, 0.1 to 0.5 wt % of Sn, 0.1 to 0.5 wt % of Zn, 0.005 to 0.1 wt % of Si, and further comprising at least one selected from the group consisting of 0.001 to 0.06 wt % of Pb, 0.001 to 0.06 wt % of Bi, 0.005 to 0.1 wt % of Ca, 0.005 to 0.1 wt % of Sr, 0.005 to 0.1 wt % of Te, 0.005 to 0.1 wt % of Se, and 0.005 to 0.1 wt % of a rare earth element, in a total amount of 0.001 to 0.1 wt %, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A.

5. The copper alloy with excellent punchability, as claimed in the claim 1 or 3, containing at least one selected from the group consisting of 0.001 to 0.06 wt % of Pb, 0.001 to 0.06 wt % of Bi, in a total amount of 0.001 to 0.1 wt %.

6. The copper alloy with excellent punchability, as claimed in the claim 3 or 4, wherein Si is added to make Cr:Si=3:1 in terms of the ratio of number of atom.

7. A method of manufacturing a copper alloy with excellent punchability, subjecting a copper alloy at least to a hot working and a cold working, wherein heat treatment is applied at a temperature of 880 to 980° C. before the hot working, and aging treatment is applied at a temperature of 360 to 470° C. before or after the cold working, and wherein the copper alloy comprises 0.2 to 0.35 wt % of Cr, 0.1 to 0.5 wt % of Sn, and 0.1 to 0.5 wt % of Zn, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A.

8. A method of manufacturing a copper alloy with excellent punchability, subjecting a copper alloy at least to a hot working and a cold working, wherein heat treatment is applied at a temperature of 880 to 980° C. before the hot working, and aging treatment is applied at a temperature of 360 to 470° C. before or after the cold working, and wherein the copper alloy comprises 0.2 to 0.35 wt % of Cr, 0.1 to 0.5 wt % of Sn, and 0.1 to 0.5 wt % of Zn, and further comprising at least one selected from the group consisting of 0.001 to 0.06 wt % of Pb, 0.001 to 0.06 wt % of Bi, 0.005 to 0.1 wt % of Ca, 0.005 to 0.1 wt % of Sr, 0.005 to 0.1 wt % of Te, 0.005 to 0.1 wt % of Se, and 0.005 to 0.1 wt % of a rare earth element, in a total amount of 0.001 to 0.1 wt %, the balance being made of Cu and unavoidable impurities, wherein, in a cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A.

9. A method of manufacturing a copper alloy with excellent punchability, subjecting a copper alloy at least to a hot working and a cold working, wherein heat treatment is applied at a temperature of 880 to 980° C. before the hot working, and aging treatment is applied at a temperature of 360 to 470° C. before or after the cold working, and wherein the copper alloy comprises 0.2 to 0.35 wt % of Cr, 0.1 to 0.5 wt % of Sn, 0.1 to 0.5 wt % of Zn, and 0.005 to 0.1 wt % of Si, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A.

10. A method of manufacturing a copper alloy with excellent punchability, subjecting a copper alloy at least to a hot working and a cold working, wherein heat treatment is applied at a temperature of 880 to 980° C. before the hot working, and aging treatment is applied at a temperature of 360 to 470° C. before or after the cold working, and wherein the copper alloy comprises 0.2 to 0.35 wt % of Cr, 0.1 to 0.5 wt % of Sn, 0.1 to 0.5 wt % of Zn, 0.005 to 0.1 wt % of Si, and further comprising at least one selected from the group consisting of 0.001 to 0.06 wt % of Pb, 0.001 to 0.06 wt % of Bi, 0.005 to 0.1 wt % of Ca, 0.005 to 0.1 wt % of Sr, 0.005 to 0.1 wt % of Te, 0.005 to 0.1 wt % of Se, and 0.005 to 0.1 wt % of a rare earth element, in a total amount of 0.001 to 0.1 wt %, the balance being made of Cu and unavoidable impurities, wherein, in a Cu matrix, a precipitation phase A of Cr or a Cr compound of 0.1 to 10 $\mu$m in maximum diameter, is provided, at a density in number of $1\times10^3$ to $3\times10^5/mm^2$, and a precipitation phase B of Cr or a Cr compound of 0.001 to 0.030 $\mu$m in maximum diameter, is provided, at a density in number that is 10 times or more of that of the precipitation phase A.

11. The method of manufacturing a copper alloy with excellent punchability as claimed in anyone of claims 7 to 10, wherein the heat treatment temperature before hot working is in the range of from 910 to 940° C.

12. The method of manufacturing a copper alloy with excellent punchability as claimed in anyone of claims 7 to 10, wherein aging treatment is applied during cold working.

13. The method of manufacturing a copper alloy with excellent punchability as claimed in the claim 12, wherein, after cold working, low-temperature annealing is applied according to batch-type annealing at a temperature of 200 to 400° C., for 0.5 to 5 hours.

14. The method of manufacturing a copper alloy with excellent punchability as claimed in the claim 12, wherein, after cold working, low-temperature annealing is applied according to running annealing at a temperature of 600 to 800° C., for 5 to 60 seconds.

* * * * *